United States Patent [19]

Yasui

[11] Patent Number: 4,590,713

[45] Date of Patent: May 27, 1986

[54] POLISHING APPARATUS

[76] Inventor: Nobuhiko Yasui, 2928, Oaza Tatsuno, Sangocho, Ikoma-gun, Nara-ken, Japan

[21] Appl. No.: 629,500

[22] Filed: Jul. 10, 1984

[51] Int. Cl.[4] ..... B24B 23/03

[52] U.S. Cl. ..... 51/170 T; 51/170 MT; 51/177; 51/262 R; 51/273; 15/49 R; 15/246

[58] Field of Search ..... 51/170 T, 170 MT, 177, 51/358, 376, 389, 241.6, 170 R, 170 TL, 170 EB, 174, 175, 176, 262 R, 273; 15/49 R, 50 R, 98, 246

[56] References Cited

U.S. PATENT DOCUMENTS

| | | | |
|---|---|---|---|
| 864,403 | 8/1907 | Beck | 51/170 T |
| 2,784,433 | 3/1957 | Verhagen | 51/177 X |
| 3,619,954 | 11/1971 | Miller | 51/170 T |
| 3,866,361 | 2/1975 | Mauck | 51/358 |
| 4,158,935 | 6/1979 | Robert | 51/170 T |
| 4,202,139 | 5/1980 | Hong et al. | 51/393 |
| 4,222,204 | 9/1980 | Benner | 51/376 X |

FOREIGN PATENT DOCUMENTS

| | | | |
|---|---|---|---|
| 821064 | 9/1959 | United Kingdom | 51/170 T |
| 716791 | 2/1980 | U.S.S.R. | 51/176 |
| 753654 | 8/1980 | U.S.S.R. | 51/176 |

*Primary Examiner*—Robert P. Olszewski

*Attorney, Agent, or Firm*—Wenderoth, Lind & Ponack

[57] ABSTRACT

A polishing apparatus includes a driving source, a polishing member driven by the driving source, and a pair of guide members. The polishing member is composed of a pair of rigid support plates and an elastic body sandwiched therebetween. The lower-positioned support plate is formed with a polishing face.

5 Claims, 14 Drawing Figures

POLISHING APPARATUS

BACKGROUND OF THE INVENTION

1. Field of the Invention

The present invention relates to an apparatus for polishing the painted surfaces of automobiles or the like.

2. Description of the Prior Art

It has been common practice to use sand paper manually with water to polish an area of an automobiles to be repainted. However, although it is laborious to perform such an operation, uniform polishing can not be expected with irregular surfaces.

SUMMARY OF THE INVENTION

Therefore, the principal object of the invention is to provide a polishing apparatus which can accomplish uniformly polished finishes.

To achieve the above object, the polishing apparatus in accordance with the invention comprises a driving source having a vertical axis of rotation, a polishing member comprising a polishing face perpendicular to the axis of rotation and rotated by the driving source, and a pair of guide members extending in directions orthogonal to the axis of rotation and disposed on opposite sides of the polishing member.

In a preferred embodiment of the invention, the polishing member comprises a pair of rigid support plates, one of the support plates being disposed at a lower position with respect to the axis of rotation and being formed with the polishing face, and an elastic body sandwiched between the pair of rigid support plates.

Hence, according to the invention, uniformly polished finishes can be ensured by means of the guide members. In addition, because of the elastic body on the polishing member, a surface having a small degree of curvature can be smoothly polished over the entire area thereof. Furthermore, since the polishing face is supported by a rigid plate, a slight unevenness of a surface to be polished can be removed and polished.

BRIEF DESCRIPTION OF THE DRAWINGS

The features and advantages of the invention will be apparent from the following description of a preferred embodiment thereof, taken in conjunction with the accompanying drawings, wherein.

DETAILED DESCRIPTION OF THE PREFERRED EMBODIMENT

Figure 1:
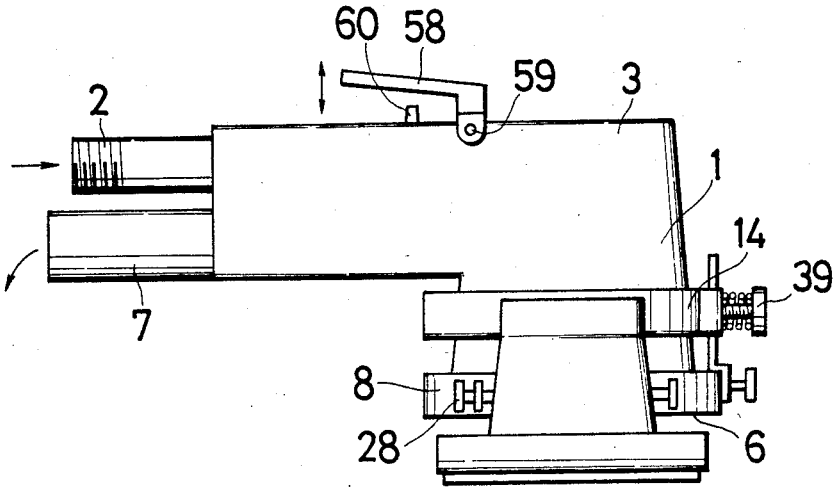
FIG. 1 is a side elevation of an embodiment of the invention.
Figure 3:
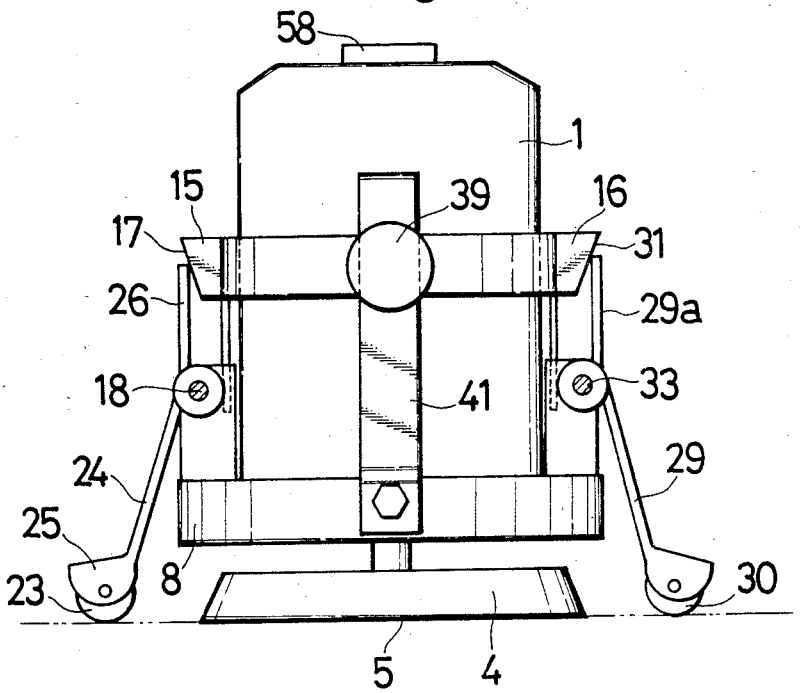
FIG. 3 is a front elevation thereof.
Figure 2:
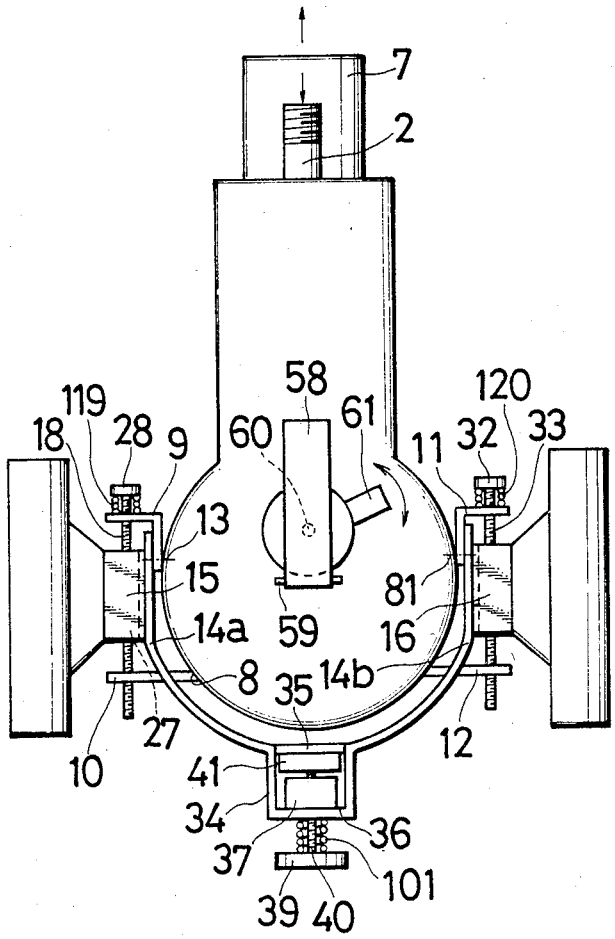
FIG. 2 is a top plan view thereof.

FIG. 1 is a side view of a preferred embodiment in accordance with the present invention, FIG. 2 and FIG. 3 are respectively a top plan view and an elevation of such embodiment. As shown in FIG. 1, a main body 1 is substantially L-shaped, and a connecting end 2 on the main body 1 receives pressurized air which drives an air pressure motor 3 integrated in the main body 1. By this air pressure motor 3 a polishing member 4 is rotated about a vertical axis of rotation, and a polishing face 5 is formed in a plane perpendicular to such axis. Dust produced by the polishing operation using the polishing member 4 is absorbed toward a vacuum source through a bottom portion 6 on the main body 1 and a connecting end 7. The connecting ends 2 and 7 are respectively connected with flexible tubes.

Figure 4:
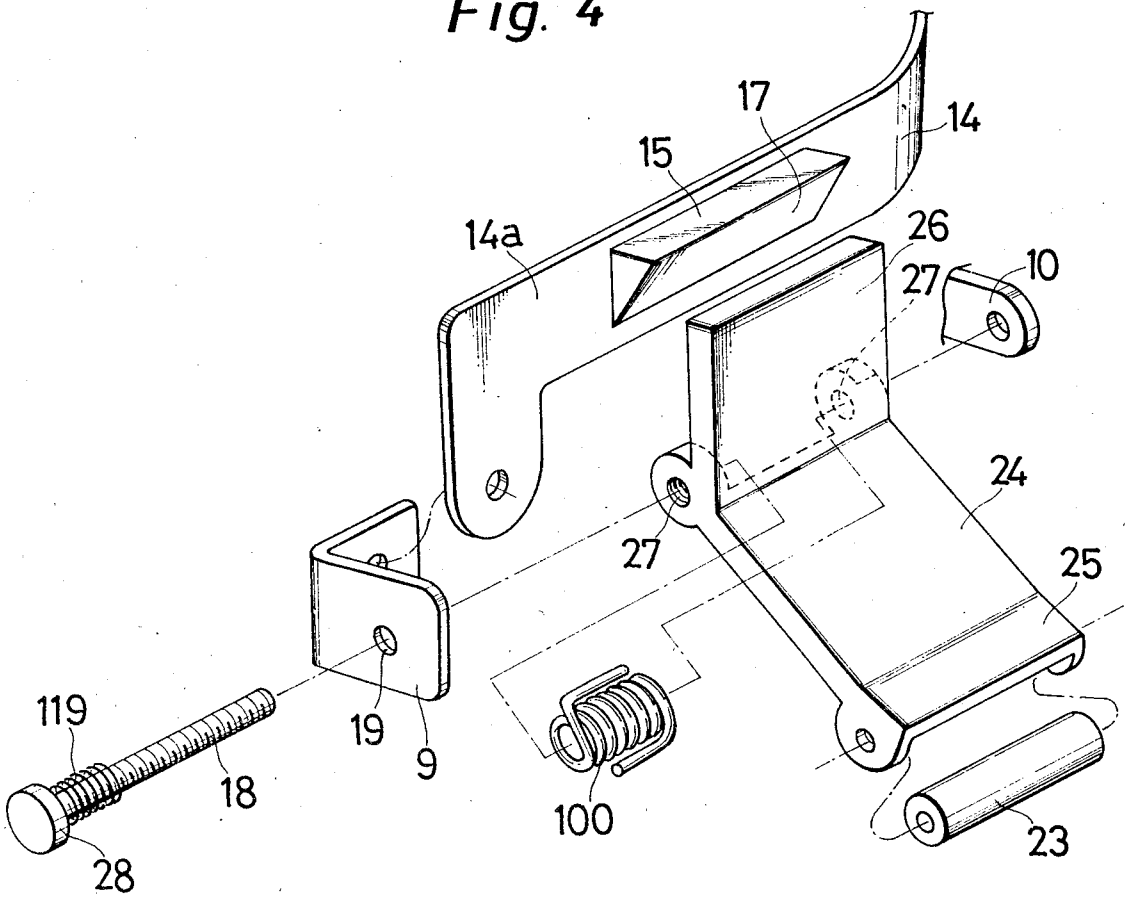
FIG. 4 is an exploded view showing in detail a roller employed as a guide member.
Figure 5:
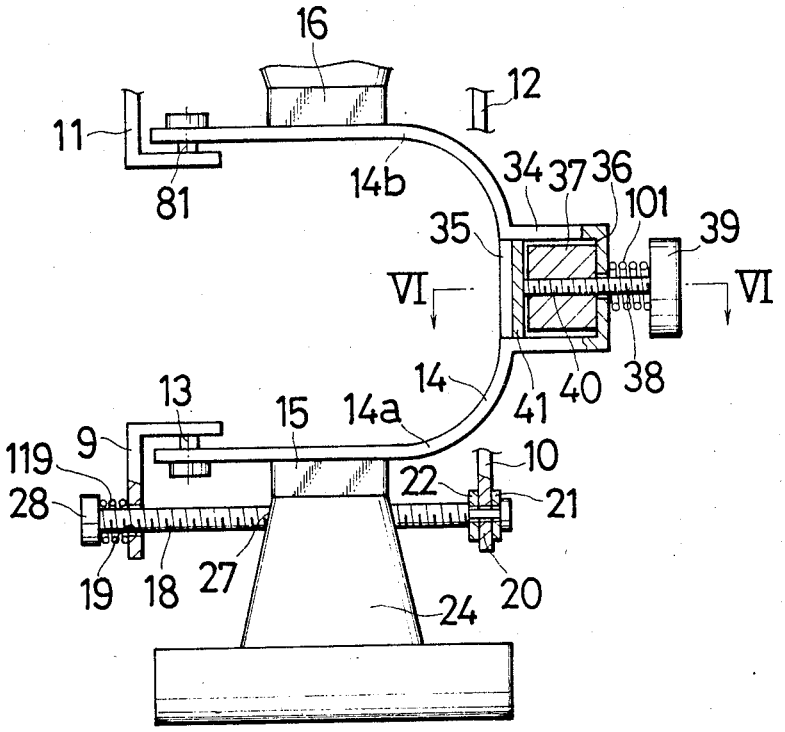
FIG. 5 is a plan view showing an arrangement of a pair of guide rollers and the construction relative thereto of the invention.

The polishing apparatus according to the invention is formed symmetric with respect to a plane which contains the vertical axis of rotation of the polishing member 4. A base member 8 formed at the bottom of the main body 1 protrudes radially outwardly of the main body 1. As also shown in FIGS. 4 and 5 the base member 8 has a first pair of circumferentially spaced brackets 9 and 10 and a second pair of circumferentially spaced brackets 11 nad 12 opposite to the pair of brackets 9 and 10. The brackets 9 and 11 substantially are L-shaped as viewed from above. Brackets 9 and 11 attached to opposite ends of a U-shaped adjusting member 14 by pins 13 and 81. These ends are fixed on the brackets 9 and 11 in such a way that the adjusting member 14 can be angularly displaced about an axis that is perpendicular to the axis of rotation. On legs **14*a* and 14*b* of the adjusting member 14 are formed respective abutting projections 15 and 16. The abutting projection 15 has an abutting surface 17 which is inclined downwardly toward the axis of rotation. The other abutting projection 16 is identical in shape with the abutting projection 15**.

The bracket 9 is provided with a screw bar 18 whose axis extends perpendicular or orthogonal to the axis of rotation and the axis of the pin 13, and which passes through a through hole 19. One end of the screw bar 18 passes through a through hole 20 formed in the bracket 10 and rings 21 and 22 provided thereon prevent the bar 18 from axial displacement. A roller 23 forming a guide member is rotatably held on a support leg 25 of an operating member 24 about an axis parallel to the screw bar 18. An adjusting portion 26 formed at an upper portion of the operating member 24 and extending at an angle thereto can make contact with the tilted surface 17 of the abutting projection 15. At a meeting point of the leg 25 with the adjusting portion 26 there is formed a pair of spaced tapped holes 27. These tapped holes 27 receive the screw bar 18. By rotating a knob 28 of the screw bar 18 the operating member 24 and the guide roller 23 can be moved along the axis of the screw bar 18. Between tapped holes 27 for the screw bar 18 is disposed a coil spring 100 surrounding the bar 18, and one end of the coil spring 100 is supported by the base member 8 and the other end of the same is supported on a surface of the operating member 24 which faces the base member 8. Coil spring 100 imparts to operating member 24 a force urging member 24 away from the base member 8 and consequently the adjusting member 26 always is urged toward the tilted surface 17. Furthermore a spring 119 is provided around the screw bar 18 between the knob 28 and the bracket 9 to thereby enable smooth rotation of the screw bar 18. The same construction is provided with respect to the leg 14*b*, including an operating member 29, a guide roller 30, and abutting projection 16 having an abutting surface 31. Likewise, by rotating a knob 32 of a screw bar 33 which is provided with a spring 120 therearound between the knob 32 and the bracket 11, the operating member 29 can be moved in a manner parallel to movement of operating member 24.

Figure 6:
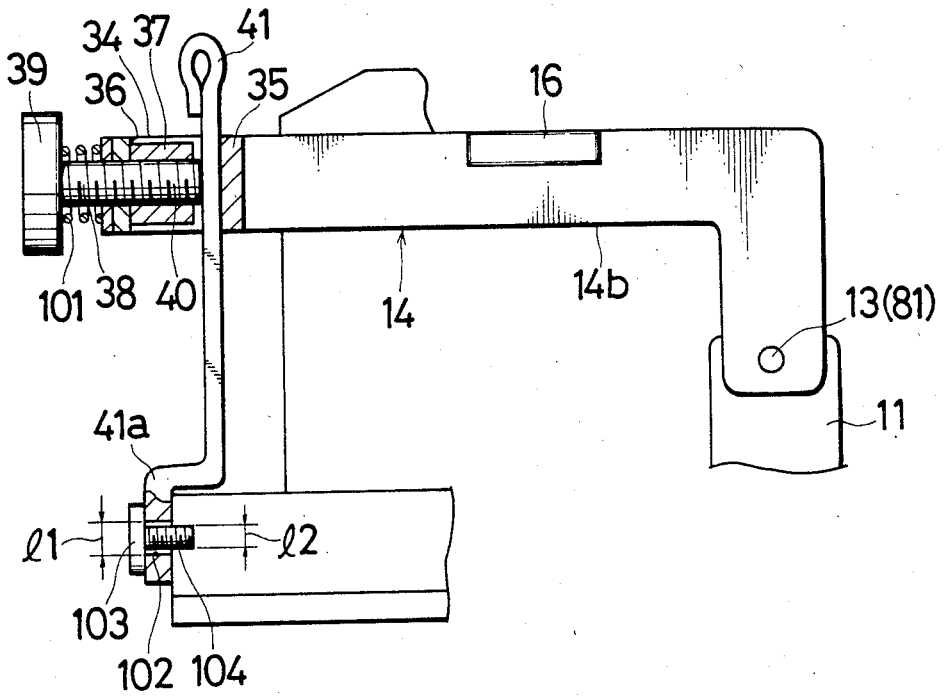
FIG. 6 is a sectional view showing in detail the vicinities of a movable element of the invention.

As clearly shown in FIG. 6, approximately at the center of the adjusting member 14 there is formed a ring unit 34. A nut 37 is disposed at a fixed wall 36 located opposite to a holder 35. A fixing screw bar 38 screwed in nut 37 and protrudes toward the holder 35. The screw bar 38 is rotated by a knob 39. One end 40 of the screw bar 38 can make contact with a movable element 41 which is fixed to the base member 8. By the end 40 of the screw bar 38 the movable element 41 can be firmly sandwiched between the end 40 and the holder 35, whereby the angular displacement positions of the adjusting member 14 about the axis of 13 (81) can be set. Through this setting the angular displacement positions of the operating members 24 and 29 about the axes of the screw bars 18 and 33 are determined. Accordingly, the positional relationship between the lower surfaces of the rollers 23, 30 and the polishing face 5 of the polishing member 4 can be adjusted so that the polishing face 5 will protrude slightly lower than the lower surfaces of the rollers 23, 30 or is flush with such surfaces.

Figure 7:
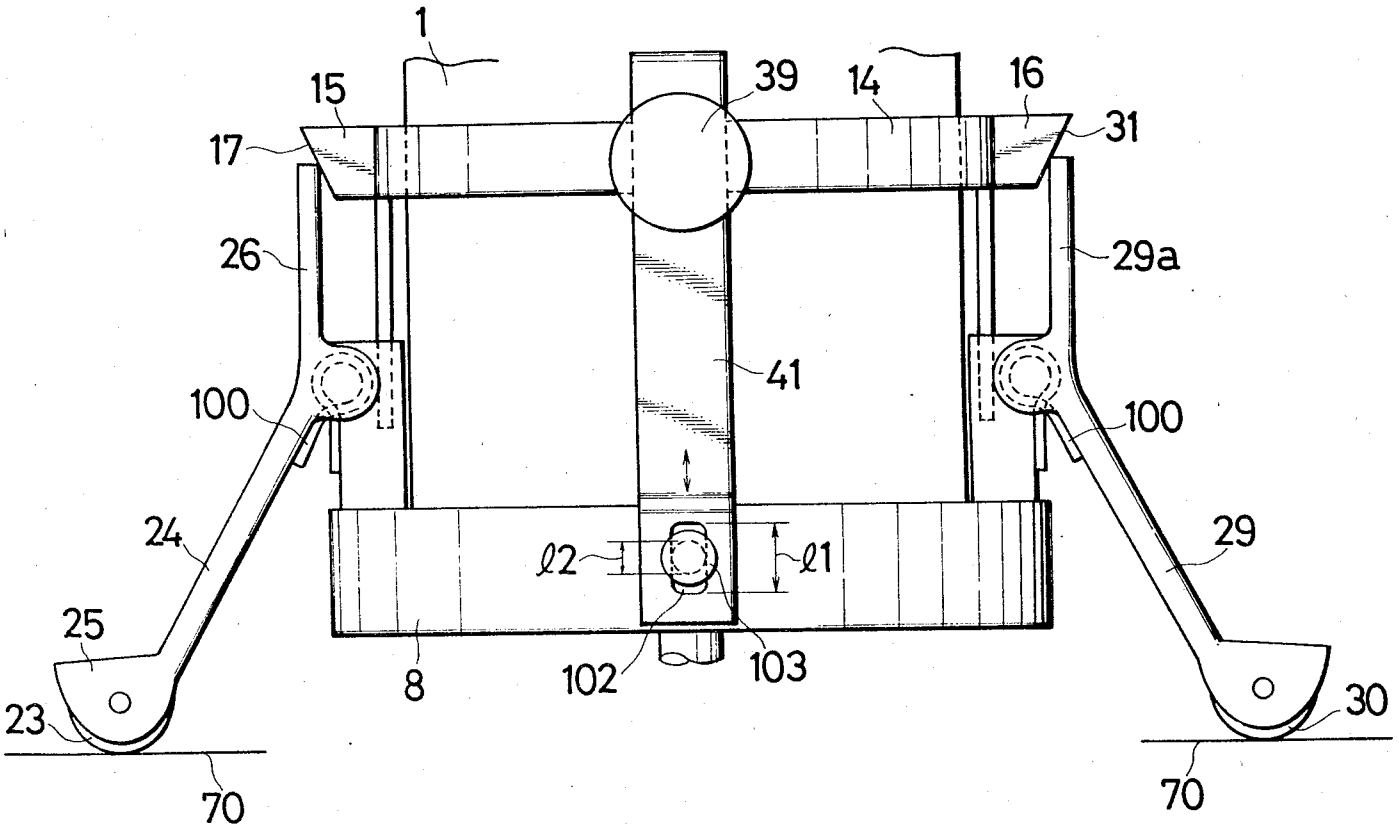
FIG. 7 is an elevational view showing movement of the movable member of the invention.

At the lower end 41*a* of the movable member 41 there is formed a slot 102 extending vertically with respect to FIG. 6. A screw 103 for fixing the movable element 41 to the base member 8 extends through slot 102 and is screwed into a tapped hole 104 of the base member 8. The relation between the elongated dimension l1 of the slot 102 and the diameter l2 of the screw 103 is expressed by $l1 > l2$ and, therefore the movable element 41 is allowed to move with respect to the screw 103 by the distance $l1-l2$. By this movement the adjusting member 14 can be slightly displaced angularly about the axes of the pins 13 and 81 with the movable element 41 being clamped between the end 40 of the screw bar 38 and the holder 35. In other words, the adjusting member 14 is fixed to the base member 8 with a certain play therebetween. When vibrations caused by a surface 70 to be polished are transferred from the rollers 23, 30 to the projections 15, 16 of the adjusting member 14 through the operating members 24, 29 and the inclined adjusting members or portions 26, 29*a* shown in FIG. 7 during a polishing operation, the play of the movable element 41 serves to enable the vibrations to be absorbed by the adjusting member 14, thereby achieving a stable rotating operation of the polishing member 4. In addition, since the rollers 23 and 30 are individually installed with respect to each other, vibrations on one roller 23 or 30 will not be transferred to the other roller 30 or 23 but will be fully absorbed by the adjusting member 14, a remarkable improvement in the polishing operation is achieved.

Figure 8:
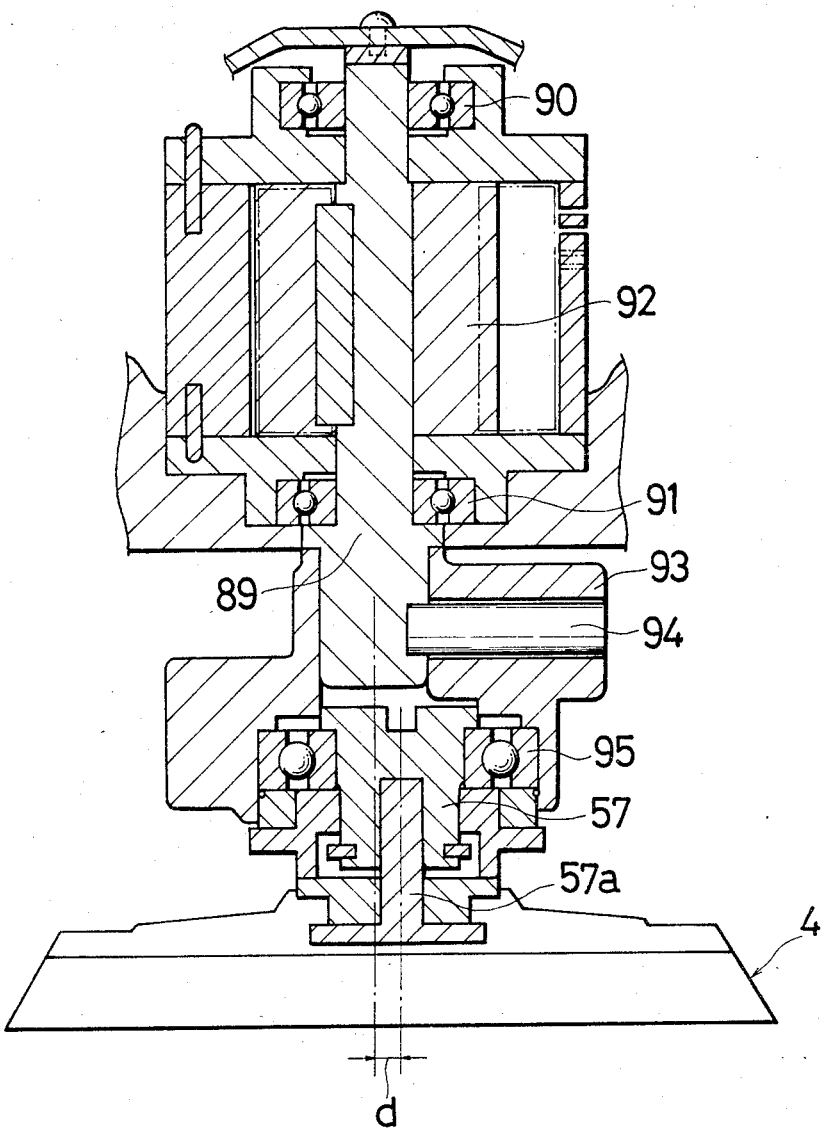
FIG. 8 is a sectional view showing the vicinities of a rotational shaft of the invention.
Figure 14:
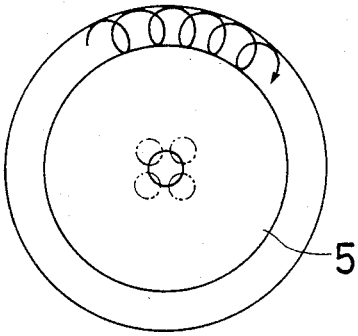
FIG. 14 is a simplified view illustrating movement of a polishing face of the invention.

FIG. 8 is a sectional view showing the vicinities of a rotating shaft 89 of the polisher. The radial force of the rotating shaft 89 is supported by bearings 90 and 91. The rotating shaft 89 is rotatably driven by a rotor 92, and a rotating cylinder 93 is fixed to the lower end of the rotating shaft 89 by means of a jig 94. Inside the rotating cylinder 93 a rotating shaft 57 is rotatably disposed through a bearing 95 so as to be eccentric by distance d with respect to the axis of the rotating shaft 89. A screw 57*a* which is fixed integrally to the polishing member 4 is screwed coaxially into shaft 57. By disposing the shafts 57 and 89 eccentrically to each other, the polishing face 5 of the polishing member 4 can be driven to move as shown in FIG. 14. The driving mechanism of the polishing member 4 is not limited to the one shown in FIG. 8, but other driving mechanisms such as to achieve a single circular movement may be employed.

Figure 9:
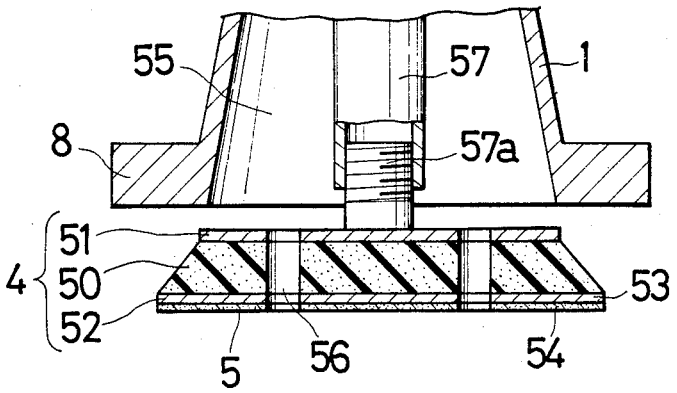
FIG. 9 is a sectional view showing a polishing member and the vicinities thereof of the invention.
Figure 10:
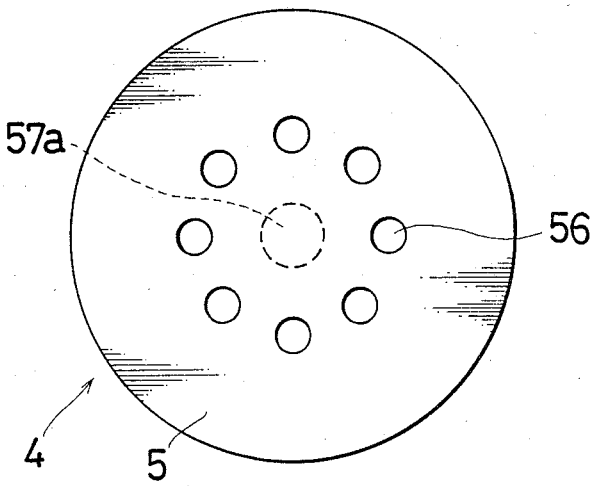
FIG. 10 is a plan view showing a bottom face of the polishing member of the invention.

FIG. 9 is an enlarged view of the polishing member 4 and the vicinities thereof. An elastic member 50 made of rubber, sponge or the like is sandwiched between a rigid support plate 51 of metal or the like and a rigid support plate 52 having the polishing face 52. The support plate 5 comprises a rigid plate 53 made of bakelite or the like and sand paper 54, which has the polishing face 5, bonded to the rigid plate 53 with an adhesive agent. A cavity 55 formed within the main body 1 is communicated with the connecting end 7 for absorbing fine dust, e.g. of the painted surfaces of automobile bodies, produced during a polishing operation by the polishing face 5, whereby the working environment is properly maintained. To improve the absorbing efficiency of dust produced, the polishing member 4 is specifically provided with a plurality of suction holes 56 which are bored through the polishing member 4 in the thickness direction thereof and which are circumferentially spaced at intervals. A screw stud 57*a* mounted on the center of the support plate 51 may be screwed into the rotating shaft 57 to connect the polishing member 4 to the shaft 57. The motor 3 is supplied with pressurized air for rotating the polishing member 4 by depressing an operating lever 58, which is mounted on the top of the main body 1, around an axis of a pin 59 so as to press a knob 60. The lever 58 is reset to its original position by a spring not shown. Another lever 61 is adapted to be angularly displaceably, such that by operating the lever 61, the flow rate of air to be supplied to the motor 3 can be varied, thereby changing the rotating speed of the motor 3.

Figure 11:
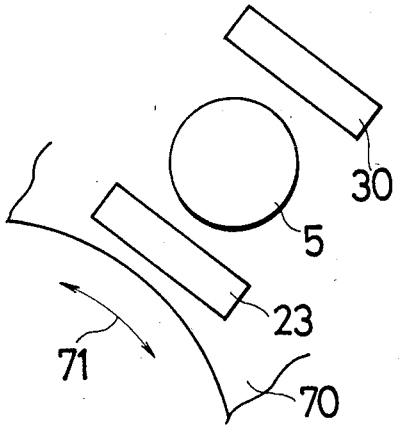
FIG. 11 through FIG. 13 are simplified views illustrating modes of operations of the polishing apparatus of the invention.
Figure 12:
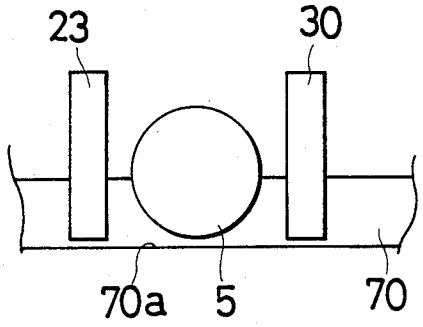

With the guide rollers 23 and 30 being in contact with the body of an automobile to be polished, rotation of the the polishing face 5 of the polishing member 4 polishes the surface of the body. In the case where the surface 70 to be polished has an outwardly protruding cylindrical portion, by placing the rollers 23 and 30 parallel to the circumferential direction of the cylindrical portion as shown in FIG. 11, that is, parallel to a direction shown by a curved arrow 71 in FIG. 11, the entire peripheral area of the outwardly protruding cylindrical portion in the surface 70 can be positively uniformly polished. In addition, by adjusting the screw bars 18 and 33 with respect to the axial positions thereof through rotation of the knobs 28 and 32, a surface 70 to be polished having a stepped portion 70*a* as shown in FIG. 12 can be fully polished.

Figure 13:
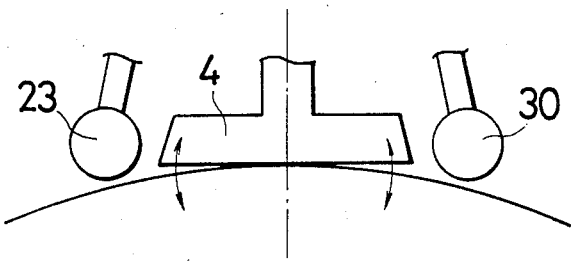

Since the support plate 52 having the polishing face 5 is fixed to the rigid support plate 51 through the elastic body 50, a somewhat uneven surface 70 can be polished evenly because of such rigidity. The elastic body 50 contributes, on the other hand, to smooth polishing of a surface 70 having a small degree of curvature, as shown in FIG. 13, over the entire area thereof. Furthermore, polishing wherein the outer edge of the polishing face 5 is employed can be effected because of the elasticity of the elastic body 50, and the operator can always check the condition of the surface being polished, so that an excellent finish can be attained.

As other embodiments of the present invention, another type of driving source for operating the polishing member may be used in place of the air pressure motor 3. Likewise, the rollers 23 and 30 may be replaced with bars or rods fixed to the operating members 24 and 29 respectively.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A polishing apparatus comprising:

a body having a base member;

a polishing member mounted on said body for rotation about a first axis, said polishing member having a polishing face extending perpendicular to said first axis;

means in said body for rotating said polishing member about said first axis;

an adjusting member having opposite ends;

means for mounting said opposite ends of said adjusting member on opposite sides of said base member for pivotal movement about a second axis orthogonal to said first axis;

a pair of abutment surfaces extending from opposite sides of said adjusting member;

a pair of guide members;

means for mounting said guide members on opposite sides of said base member for pivotal movement about respective third axes extending orthogonal to said first and second axes; and said guide member mounting means including means cooperating with respective said abutment surfaces for varying the positions of said guide members with respect to said polishing member in response to pivotal movement of said adjusting member with respect to said base member about said second axis.

2. An apparatus as claimed in claim 1, further comprising means for selectively pivoting said adjusting member about said second axis.

3. An apparatus as claimed in claim 1, wherein said guide member mounting means further includes means for selectively adjusting the positions of said guide members with respect to said base member in directions along respective said third axes.

4. An apparatus as claimed in claim 1, wherein said abutment surfaces are inclined downwardly and inwardly of respective sides of said adjusting member, and said varying means comprises operating members supporting respective said guide members about said third axes and inclined portions extending from respective said operating members and maintained in contact with respective said inclined abutment surfaces.

5. An apparatus as claimed in claim 1, wherein said polishing member comprises a pair of rigid support plates sandwiching therebetween an elastic body, one of said support plates having said polishing face.

* * * * *